US008474543B2

(12) United States Patent
Kotefski et al.

(10) Patent No.: US 8,474,543 B2
(45) Date of Patent: Jul. 2, 2013

(54) METHOD AND APPARATUS FOR CONTROLLING THE FLOW OF FLUIDS FROM A WELL BELOW THE SURFACE OF THE WATER

(76) Inventors: Stojan Kotefski, Bloomingdale, NJ (US); Nikola Kotevski, Bloomingdale, NJ (US); Dae Shin, Tampa, FL (US)

( * ) Notice: Subject to any disclaimer, the term of this patent is extended or adjusted under 35 U.S.C. 154(b) by 310 days.

(21) Appl. No.: 12/843,041

(22) Filed: Jul. 25, 2010

(65) Prior Publication Data

US 2012/0018174 A1 Jan. 26, 2012

(51) Int. Cl.
*E21B 29/12* (2006.01)

(52) U.S. Cl.
USPC ..... 166/386; 166/363

(58) Field of Classification Search
USPC ..... 166/364, 386, 363, 80.1
See application file for complete search history.

(56) References Cited

U.S. PATENT DOCUMENTS

| | | | | |
|---|---|---|---|---|
| 4,336,843 | A * | 6/1982 | Petty | 166/353 |
| 4,417,624 | A | 11/1983 | Gockel | |
| 5,205,358 | A * | 4/1993 | Mitzlaff | 166/187 |
| 8,205,677 | B1 * | 6/2012 | Salkin | 166/363 |
| 2002/0117308 | A1 | 8/2002 | Dallas | |
| 2004/0099420 | A1 | 5/2004 | Kotrla et al. | |
| 2006/0124304 | A1 * | 6/2006 | Bloess et al. | 166/285 |
| 2007/0034379 | A1 | 2/2007 | Fenton et al. | |
| 2011/0303416 | A1 * | 12/2011 | Herman, II | 166/350 |
| 2012/0000666 | A1 * | 1/2012 | Cochrane | 166/363 |
| 2012/0012329 | A1 * | 1/2012 | Klapyk et al. | 166/363 |
| 2012/0160509 | A1 * | 6/2012 | Caldwell et al. | 166/363 |

OTHER PUBLICATIONS

International Search Report issued on Dec. 21, 2011 in counterpart PCT Application No. PCT/US2011/044444.

* cited by examiner

*Primary Examiner* — Daniel P Stephenson

(57) ABSTRACT

A fluid control device is provided for controlling and/or halting an uncontrolled flow of petroleum or natural gas from an open well head on the sea floor. The fluid control device includes an elongated member having a diameter smaller than the inside diameter of the well head casing. A tapered section in connection with the elongated section, has a diameter equal to or greater than the inside diameter of the well head casing. An end section connected to the tapered section has a diameter greater than or equal to the outside diameter of the well head casing. The fluid control device, under its own mass or under an external force, overcomes the upward forces created by the flowing petroleum or natural gas, resulting in sufficient downward movement of the fluid control device and contact with the open well to seal the well head casing or drill pipe.

15 Claims, 12 Drawing Sheets

METHOD AND APPARATUS FOR CONTROLLING THE FLOW OF FLUIDS FROM A WELL BELOW THE SURFACE OF THE WATER

BACKGROUND OF THE INVENTION

1. Field of the Invention

The present invention relates in general to a method and apparatus for controlling the flow of fluids from a subsurface well, i.e., a well positioned below the surface of the water. More particularly, the present invention provides a method and apparatus for controlling and plugging an undersea oil and/or gas well.

2. Description of the Related Art

In the production of fluids such as petroleum and/or natural gas from subterranean formations, accidents can occur due to human and equipment malfunctions or the like, thereby occasionally producing a condition known as blowout. In such instances, the flow of fluids from a subterranean formation under substantial pressure is unrestricted, with the fluids flowing to the surface, i.e., a sea floor or a land surface. In such instances, it is desirable that a method and apparatus be available for controlling or stopping the flow of such petroleum and/or natural gas because a valuable resource is being wasted and because such fluids pollute the environment when released in an uncontrolled manner.

A number of techniques have been tested and used for controlling the flow of fluids from subterranean formations. For example, U.S. Patent Publication No. US 2002/0162657 A1 discloses a method and apparatus for plugging a well bore using a device to perforate the well casing, and then pumping in cement and squeezing the cement through the perforations and into the formation therearound. U.S. Patent Publication No. US 2009/10277637 A1 discloses a method of plugging and abandonment of an undersea oil well. This method involves severing a well string that extends into an oil well from an oil platform. U.S. Pat. No. 4,417,624 discloses a method and apparatus for controlling the flow of fluids from an offshore oil well involving passing a continuous pipe from a well platform into the open well bore and then pumping a plugging material such as cement into the well bore through the continuous pipe.

In another commonly used method, additional well bores are drilled to intersect with the uncontrolled well bore, so that a plugging fluid such as cement, drilling mud or the like can be pumped into the formation to kill the well. Furthermore, other conventional techniques have involved the use of explosives and the like.

In many instances, blowouts occur during drilling operations. In such instances, it is quite common for the drill ship or drilling rig to move away from the well quickly when the blowout occurs; and in some instances, the drilling rig explodes and is blown away from the well head. As a result, as in the situation with the BP Deepwater Horizon accident, the well bore may be left open at the well head on the ocean floor as a result of equipment malfunction and the like, or at the well head on land. In such instances, the well bore is substantially open so that the flow of petroleum and/or natural gas is unimpeded, thereby resulting in an environmental and economic catastrophe.

Accordingly, it is an object of the present invention to provide a method and apparatus for controlling and/or stopping the control of fluids from such open well bores.

BRIEF SUMMARY OF THE INVENTION

In order to achieve the object of the present invention, the present inventors have endeavored to provide a device and method utilizing same to control/cap a blowout. Accordingly, it has now been unexpectedly discovered that control of the flow of fluids from open well bores fluidly communicating the surface with a subterranean formation can be accomplished by using an apparatus including a fluid control device comprising an elongated round rod (elongated member) having one end with a diameter substantially smaller than the inside diameter of the well bore to be plugged and an opposite end or a portion therebetween with a diameter at least as great as the inside diameter of the well bore.

In a preferred embodiment, the fluid control device comprises a plurality of elongated round sections with a smaller diameter section (elongated member) disposed at one end. The smaller diameter allows for a smaller area upon which the fluid flow can exert forces, which can undesirably deflect the positioning of the remaining sections. This allows for ease in guiding and positioning the elongated member into the well bore casing so that the larger diameter sections of the device can be positioned without them being forced outside of radius of the overflowing pipe section. Further, the elongated member is preferably solid, so as to muffle vibrations and shock waves caused by forces exerted thereon by the fluid flow. The smaller diameter section is preferably connected or formed integrally with an adjacent tapered section.

The adjacent tapered section increases in diameter until the diameter of this tapered section exceeds the inside diameter of the well bore. In an alternative preferred embodiment, the adjacent tapered section has a greatest outside diameter smaller than the inside diameter of the well bore, and is in connection with one or more additional sections, at least one of which has a diameter exceeding the inside diameter of the well bore.

In a preferred embodiment, the fluid control device is formed with a shoulder attached to or formed integral therewith which is operable to come into engagement with the top of the well casing as the fluid control device is lowered into the open well bore. Preferably, the shoulder is greater in diameter than the outside diameter of the well bore casing.

In another preferred embodiment, the diameter of the elongated member is preferably less than about one half, more preferably from about one-tenth to one-half, most preferably from about one-eighth to one-third the diameter of the inside diameter of the well bore to be plugged. By forming the elongated member with a diameter substantially smaller than the inside diameter of the well head casing, resistance to insertion thereof into the well head casing by the fluid flow is greatly decreased.

In another preferred embodiment, the fluid control device is used in conjunction with a support means positioned on the floor of the body of water adjacent the well bore to be plugged. For example, the support means can be positioned on the sea floor over the well head extending from the sea floor. Preferably, an alignment means is positioned on support means above the open well bore, said alignment means being adapted to align the position of the fluid control device over the open well bore as the fluid control device is lowered into the well bore. The mere mass of the fluid control device can be such that it overcomes the forces created by the fluid flowing from the well bore.

Another method of placing and positioning the elongated member (smaller diameter section) of the fluid control device into the well head casing is lowering same from a ship or a drilling platform into engagement with the alignment means, and then into the well bore casing. After the elongated member of the fluid control means is inserted into the well head casing, a tapered section of the fluid control means is then lowered into the well head casing. The adjacent tapered section, or another section above the adjacent tapered section as described above, increases in diameter until the diameter of the fluid control device is equal to the inside diameter of the well head casing.

This gradual differential in diameter along the length of the fluid control device allows for a gradual pressure increase in the outflowing pipe (i.e., the well head casing). By only gradually increasing the pressure during insertion of the fluid control device into the well head casing, the potential of damage to the well head casing is greatly reduced, as there is no downward shock wave propagated, and the "Hoop" pressure is under the yield points of the drill piping).

At this juncture, the downward (gravitational) forces due to the weight of the fluid control device and/or force being exerted thereon by an external device/system exert a force greater than the upward forces exerted on the fluid control device by the fluids flowing from the open well head casing. These upward forces exerted by the fluid from the well head casing (pipe) tend to push the fluid control device upward and out of the well bore, and these forces continue until the final closure point where the solid tool diameter is the same or greater than the inside diameter of the well head casing. At this point, the tapered section has an interference fit, which creates the final fit/seal with the well head casing.

In a preferred embodiment, a soft material (sealing material) such as lead, rubber, a softer metal such as aluminum, etc., is coated, affixed or disposed adjacent on/to the outer circumference of at least a portion of the fluid control device, so as to be operable to form a interference or compression fit (seal) between the fluid control device and the well head casing and/or outflowing piping.

In another preferred embodiment, sections or portions of sections of the fluid control device, including but not limited to the adjacent tapered section and sections above same, are coated with a soft (sealing) material as described above such that as the fluid control device is lowered to specific depths in the well bore pipe, cracks in the well bore pipe below the sea surface can be surpassed by smaller diameter sections of the fluid control device until the section or portion of section coated with the soft material having an outer diameter equal to the inside diameter of the well bore pipe below the cracks seats/seals against the well bore pipe below the cracks. This enables sealing of the well bore pipe below the cracks, thereby preventing leakage/outflow of oil, gases, fluids, etc. into the substrate surrounding the well bore. In particular, this preferred embodiment provides the ability to seal cracked piping even thousands of feet below the subsurface.

In another preferred embodiment, a shoulder is formed on the tool which is larger in diameter than the well head casing. As the tool is lowered into the well head, the shoulder of the tool comes in contact with and rests on the top of the well head casing. Preferably, the soft material (sealing material) described above is disposed on and/or adjacent to the shoulder, so as to assist in providing a tight seal between the shoulder and well head casing.

In a further preferred embodiment, threads are formed on/adjacent to the larger end of the fluid control device so as to engage threads formed on the well head casing. The threaded engagement between the fluid control device and well head casing assists in forming a fluid tight seal between the well head casing and/or outflowing piping and the fluid control device.

In another preferred embodiment, the fluid control device comprises a plurality of sections having different cross-sections, where one end of the fluid control device has the smallest circular cross section which is to be inserted first in the well head. This first section of smallest diameter, having a tip, connects with a tapered round section at an end opposite the tip, the tapered round section increasing in diameter until the diameter of the tool is larger than the inside diameter of the well casing. These separate sections of the fluid control device can be formed integral with one another, or can be formed separately and then connected by threaded engagement, welding, or the like.

In accordance with the above, in a first preferred embodiment there is provided an apparatus for controlling and/or stopping the flow of petroleum and/or natural gas from an open well head on the sea floor in which the well head is in communication with a subterranean formation, said apparatus comprising:

a flow control device comprising:

(a) an elongated member which can be lowered at least partially into an open well head and which is comprised of a plurality of sections of different diameters, including a lowermost end section having a constant diameter less than about half of the inside diameter of the well head casing, and (b) a tapered section in connection or formed integral with the elongated member, the tapered section having a variable diameter which increases to a diameter at least equal to the inside diameter of the well head casing, and (c) an end section in connection or formed integral with the tapered section, the end section having a diameter greater than or equal to the outside diameter of the well casing, wherein the overall mass of the fluid control device exerts a force sufficiently great so as to overcome any upward force created by flowing fluids, such as petroleum and/or natural gas, and wherein which mass results in the downward movement of the fluid control device into the well head casing resulting in closure of the well head.

In a second preferred embodiment used in connection with the first preferred embodiment is an apparatus wherein the fluid control device is comprised of a plurality of sections which can be connected together.

In a third preferred embodiment there is provided in connection with the second preferred embodiment above, an apparatus wherein one or more of the plurality of sections are in threaded engagement with one or more adjacent sections.

In the fourth preferred embodiment there is provided in connection with the third preferred embodiment, wherein the apparatus further comprises a guide means operable to align the fluid control device with/into the open well head.

In the fifth preferred embodiment there is used in connection with the first through fourth preferred embodiments above, wherein the apparatus/fluid control device is lowered into the well head casing from a drilling ship.

In the sixth preferred embodiment there is provided in connection with the first through fifth preferred embodiments above the apparatus wherein the drill ship uses drilling pipe (in communication with the apparatus/fluid control device) to lower the fluid control device to the sea floor and into the open well head.

In the seventh preferred embodiment a method is provided for controlling uncontrolled flow of petroleum and/or natural gas from an open well head projecting from the sea floor, the method comprising:

(a) positioning a fluid control device above an alignment means, which in turn is positioned above an open well casing on the sea floor, (b) lowering the fluid control device through the alignment means and into the open well casing, and (c) lowering the fluid control device into the open casing until the fluid control device seals the well casing, thereby halting the flow of petroleum and/or natural gas therefrom.

In an eighth preferred embodiment there is provided in connection with the seventh preferred embodiment a method wherein a drilling ship is used to lower the fluid control device into the open well head casing.

In a ninth preferred embodiment there is provided in connection with the seventh preferred embodiment a method wherein the fluid control device is lowered into the well head casing by means of drilling pipe in communication with the fluid control device to the sea floor.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 8(*b*) is a partial enlarged cross-sectional view of the fluid control device of the present invention and well head casing, as shown in section "A" of FIG. 8(*a*), illustrating the alignment and disposition of the device right before the device is lowered into the well head casing. In this case, the diameter ratio of the outflowing pipe and the fluid control device allows for the fluid control device to be easily positioned, aligned and placed into the outflowing pipe with least resistance.

FIG. 9(*b*) is a partial enlarged cross-sectional view of the fluid control device of the present invention and well head casing, as shown in section "A" of FIG. 9(*a*), illustrating the alignment and disposition of the device right after the smallest diameter section thereof has been lowered into the well head casing.

FIG. 10(*b*) partial enlarged cross-sectional view of the fluid control device of the present invention and well head casing, as illustrated in section "A" of FIG. 10(*b*), illustrating the alignment and disposition of the device right as the tapered section thereof is being lowered into the well head casing as shown in area "A" of FIG. 10(*a*).

FIG. 11(*b*) is a partial enlarged cross-sectional view of the fluid control device of the present invention and well head casing, as illustrated in section "A" of FIG. 11(*a*).

FIG. 11(*c*) is a partial enlarged cross-sectional view of the fluid control device of the present invention and well head casing, as illustrated in section "B" of FIG. 11(*a*).

DETAILED DESCRIPTION OF THE INVENTION

Figure 4:
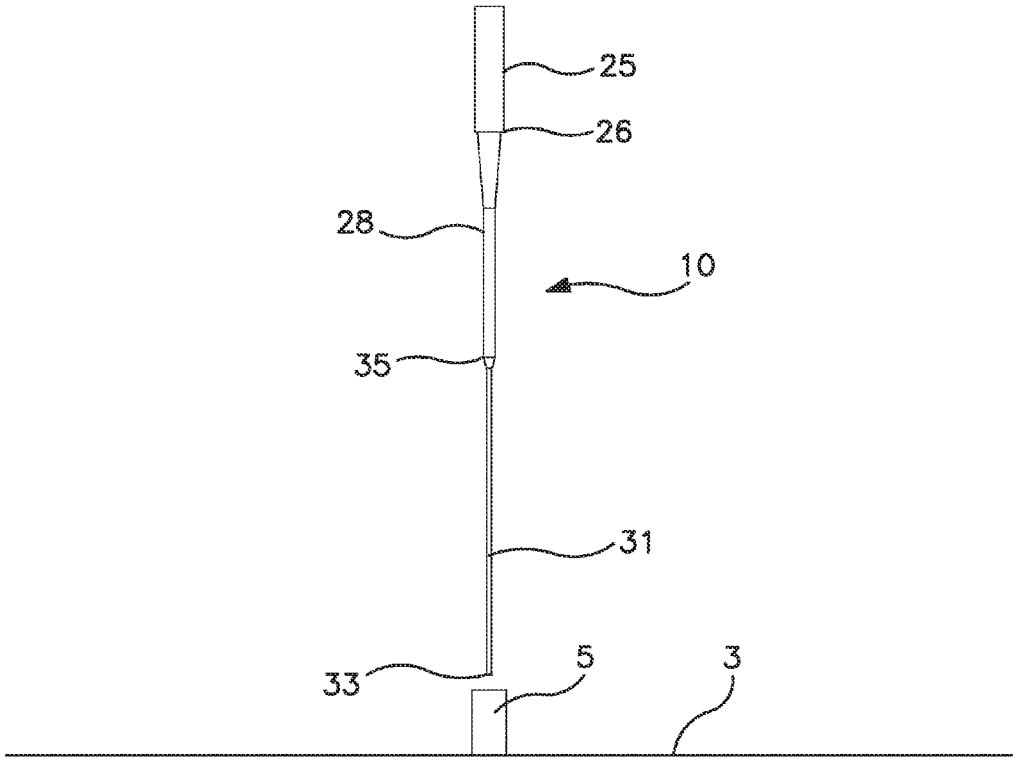
FIG. 4 is a side view of the fluid control device of the present invention, illustrating various sections thereof as the device is lowered into the well head casing.
Figure 8A:
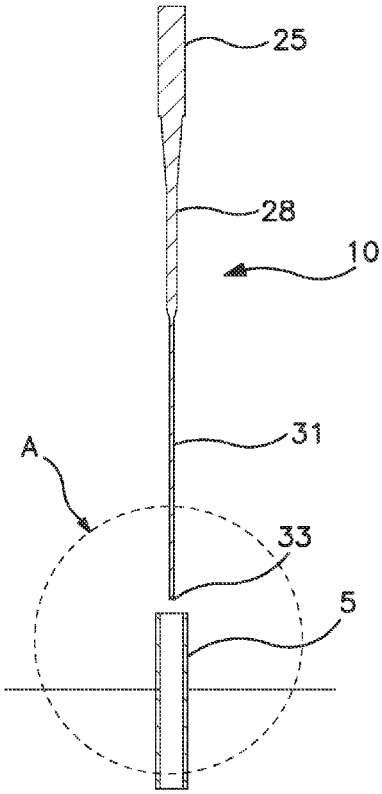
FIG. 8(*a*) is a cross-sectional view of the fluid control device of the present invention and well head casing, illustrating the alignment and disposition of the device right before the device is lowered into the well head casing.
Figure 8B:
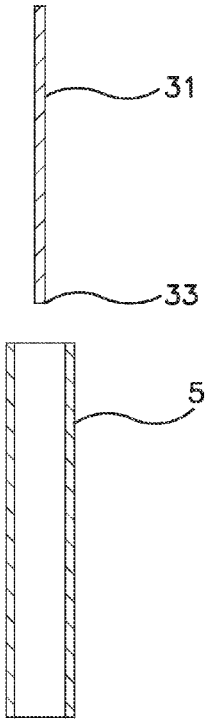
Figure 9A:
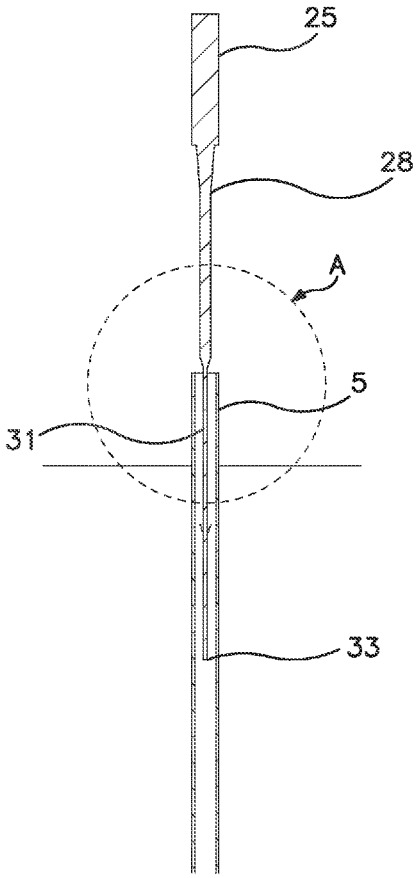
FIG. 9(*a*) is a cross-sectional view of the of the fluid control device of the present invention and well head casing, illustrating the alignment and disposition of the device right after the smallest diameter section thereof has been lowered into the well head casing. This gradual diameter increase in the fluid control device also increases the outflowing pipe as the segments of the fluid control device enter the outflowing piping. This gradual pressure build up not only reduces the fluid flow but also stops damage to the outflowing pipes from shock or sudden pressure buildup that can exceed the material properties of the outflowing piping.
Figure 9B:
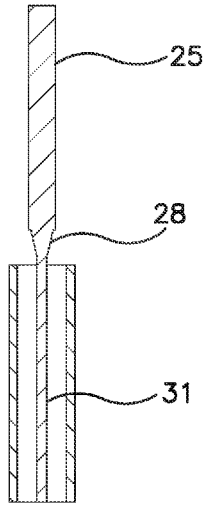

As illustrated in FIGS. 4 and 8(*a*), the fluid control device 10 of the present invention is generally comprised of three members, i.e., elongated member 31, tapered portion 28 (which may be coated with a soft material such that the diameter of the tapered portion is greater than the inside diameter of the outflowing pipe) and top portion 25. In particular, the elongated member 31 having a tip 33 at one end thereof, is smallest in diameter, and is disposed at one end of the device 10 so as to be the first element of the device 10 to be inserted into a well head casing 5. The elongated member 31 is in communication with, or formed integral with, a tapered portion 28 at juncture 35, the juncture 35 being at an end opposite the tip 31. The elongated member 28 is in communication with or formed integral with top portion 25. Top portion 25 preferably has a shoulder 26 formed therein, the shoulder 26 having a diameter equal or greater that the outside diameter of the well head casing 5.

In a preferred embodiment, as mentioned above and as illustrated in FIG. 12, in order to seal a subsurface crack 59 in the well bore pipe 61, the fluid control device 10 is configured such that a tapered portion 28 increases in diameter greater than the inside diameter of the pipe 61 below the crack 59, and is coated with a soft material 63 in a portion adjacent the crack 59 so as to seal the pipe in the area adjacent the crack 59. The pipe 61 may alternatively be sealed well below the crack 59, by tailoring the diameter of the fluid control device accordingly. In either event, by sealing the pipe 61 below the crack 59, leakage of outflowing fluids into the surrounding substrate via the crack 59 may be prevented.

Preferably, each segment (section) of the fluid control device 10 is tapered, even if ever so slightly, such that that there are no impacts between the device 10 and the well bore casing 5 or pipe 61 that can damage the casing or pipe. There is no limitation on the degree of taper; the taper can be hundreds of feet long and can have a over lay of one hundred feet or more of soft material greater than the inside diameter of the outflowing piping so that a seal can be formed between the fluid control device and the well bore pipe hundreds or even thousands of feet below the surface. The soft material is press fit, so as to create an interference/compression fit, until the fluid flow from a solid or cracked outflowing pipe is halted.

Figure 1:
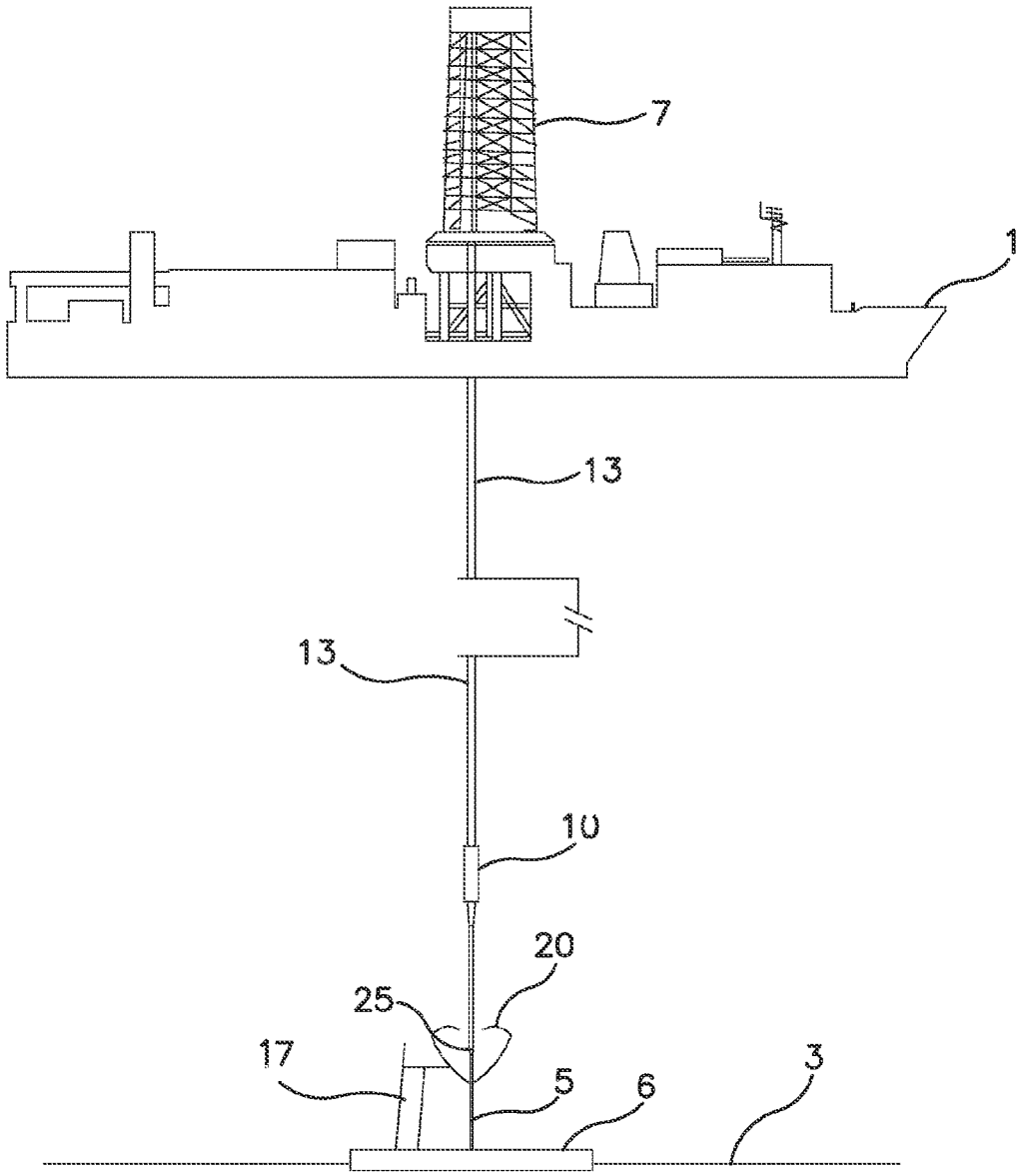
FIG. 1 is a side view of a drilling ship fitted with a drilling rig positioned above an open well head on the bottom of the sea, illustrating in particular the fluid control device of the present invention for controlling the flow of fluids from the open well head extending from the sea floor.

The fluid control device of the present invention shown in FIG. 4, including equipment for using same, is depicted generally in FIG. 1, in which a drilling ship 1 is positioned over an open well casing 5 projecting from the sea floor 3. Drilling ship 1 comprises a derrick 7 used for lowering the fluid control device 10 of the present invention to the sea floor 3 and into open well head 5.

Surrounding well head 5 is a platform 6 which rests on the sea floor 3. Platform 6 provides a stable, level base upon which to mount a support means 17 along which can be mounted alignment means 20 including a funnel shaped guide means. Optionally, fluid control device 10 can be guided to a position directly over well head 5 by means of alignment means 20 resting on support means 17. The drilling ship 1 can be stabilized with a geographic positioning system (GPS) in communication with on board stabilizers, or any other suitable conventional device to maintain the drilling ship 1 in a fixed position during the process of installing fluid control device into open well head 5.

Figure 2:
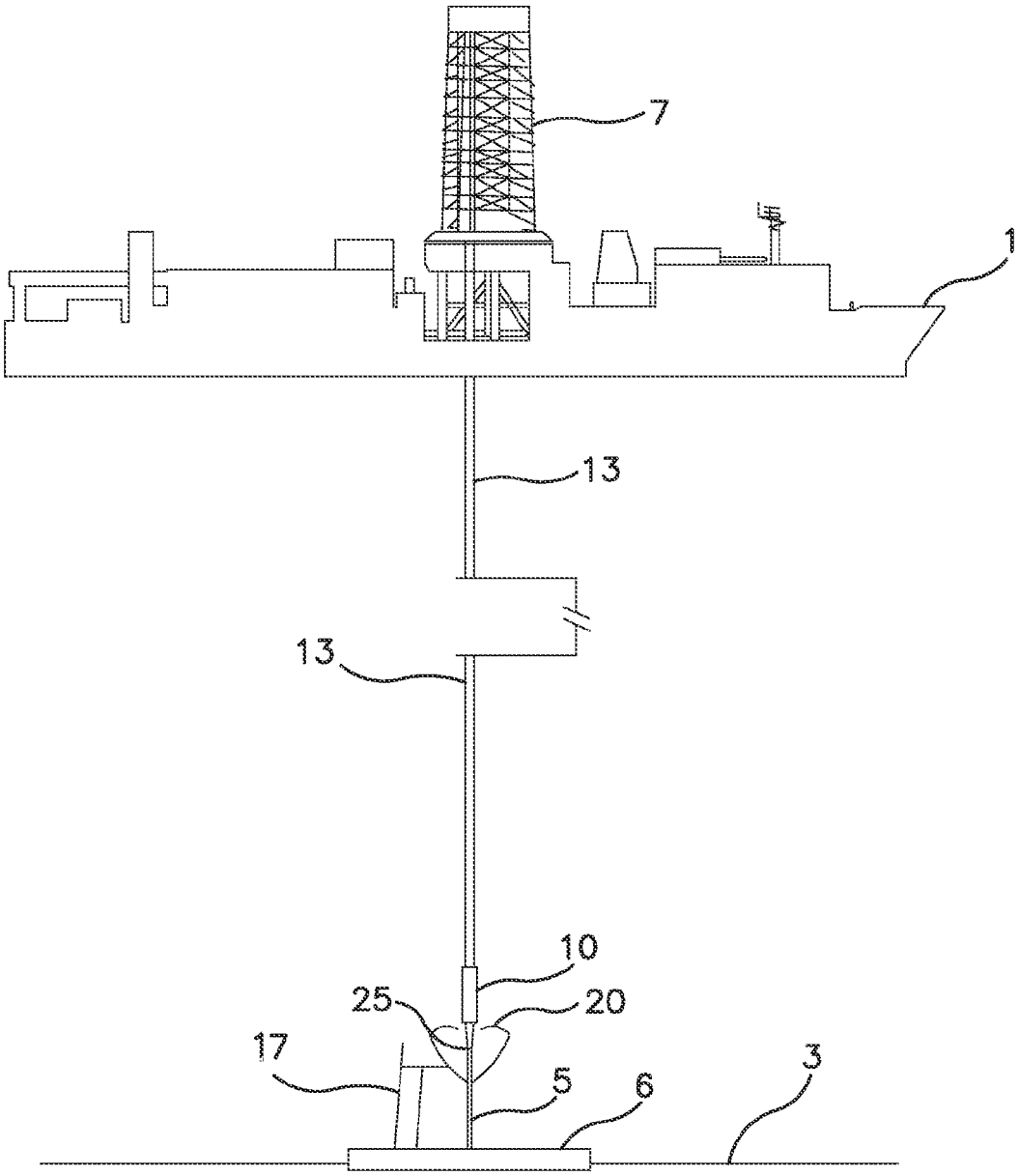
FIG. 2 is a side view of the drilling ship shown in FIG. 1, in which the fluid control device of the present invention is being lowered into the open well head.
Figure 3:
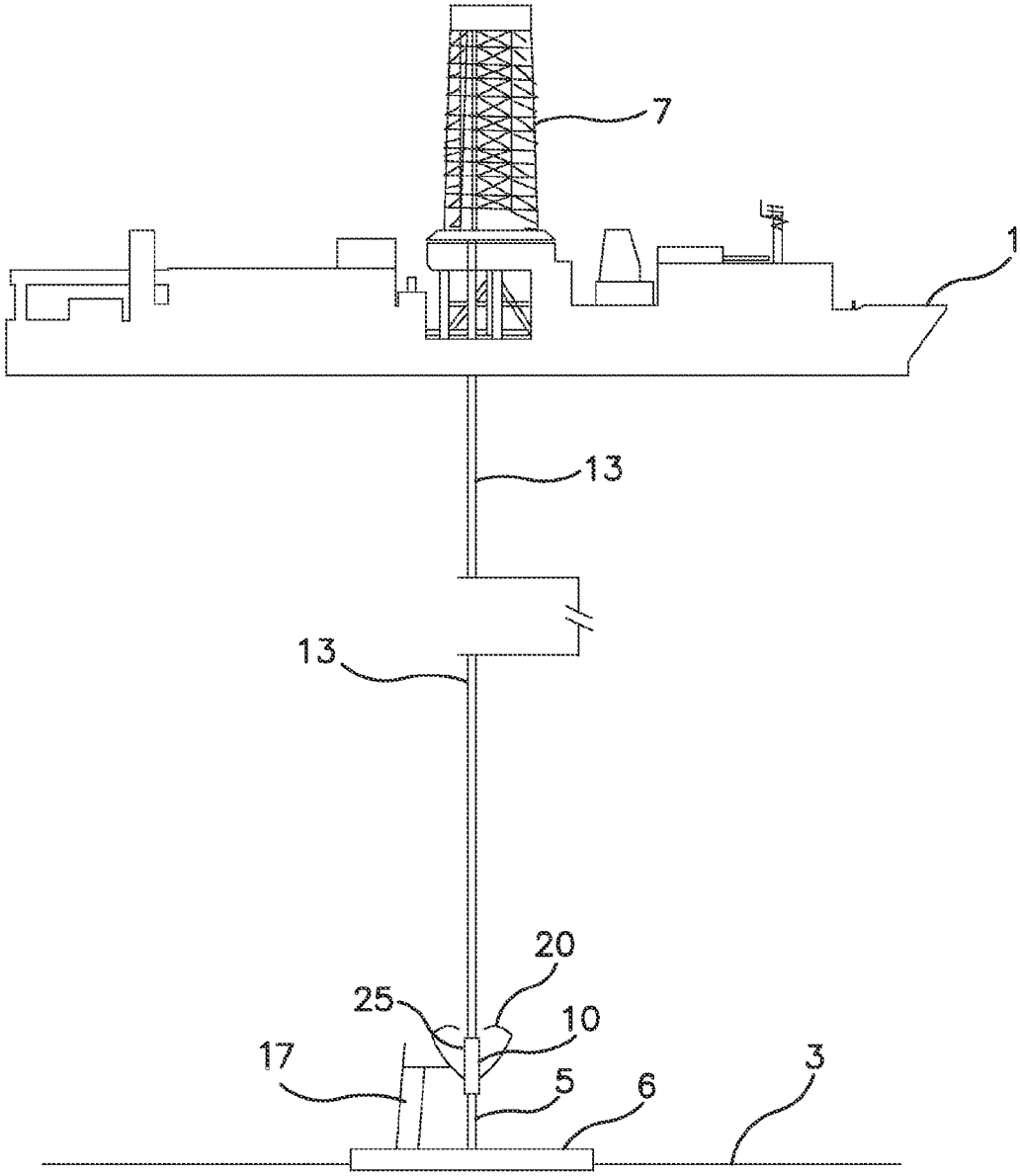
FIG. 3 is a side view of the drilling ship shown in FIG. 1, in which the fluid control device of the present invention has been deployed by being lowered into the open well head to plug same and halt the flow of fluids from the well head casing.

FIGS. 1-3 illustrate one preferred method of lowering fluid control device 10 from the drilling ship 1 using conventional drilling pipe 13, which may be connected one to the other by means of threads (not shown), friction welds, or other conventional means of attachment. Preferably, the end of drilling pipe 13 can be secured to the fluid control device 10 by means of threads or any other conventional locking means used in the drilling industry. In an alternative preferred embodiment, steel (or other high tensile strength) cable (not shown) can be used to lower fluid control means 10 from drilling ship 1 into open well head 5. Any conventional locking means can be used to secure fluid control means 10 to the steel cable.

Figure 5:
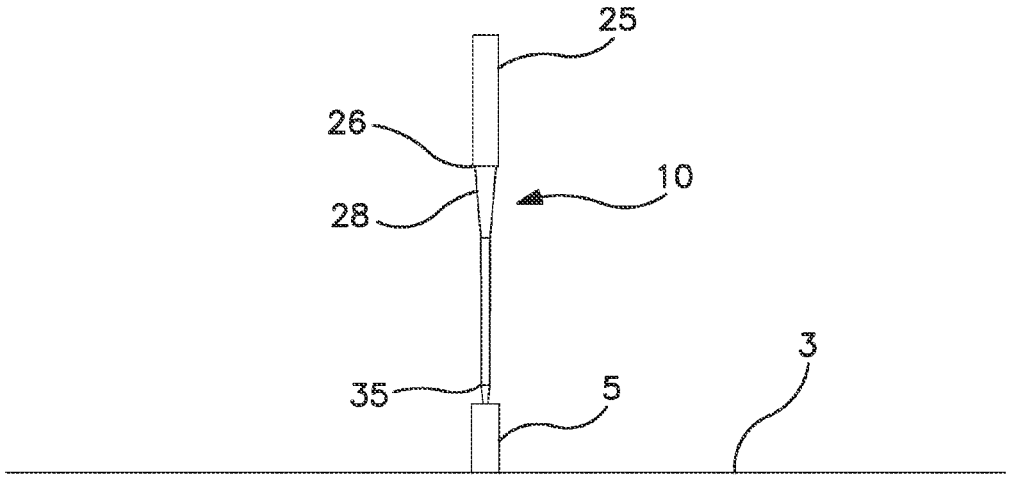
FIG. 5 is a side view of the fluid control device shown in FIG. 4, illustrating a tapered section thereof when it is about to enter the well head casing.
Figure 6:
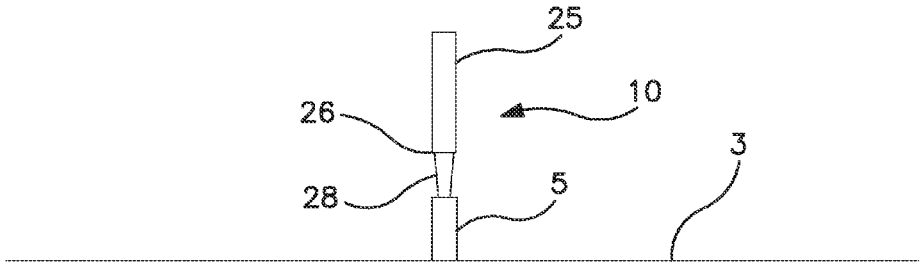
FIG. 6 is a side view of the fluid control device shown in FIGS. 4 and 5, illustrating a tapered section of the apparatus in the well head casing.
Figure 7:
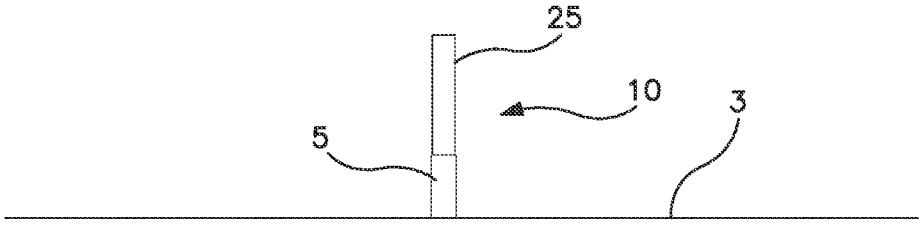
FIG. 7 is a side view of the fluid control device of the present invention, illustrating the disposition of the fluid control device when a shoulder therein is resting on the top of the well head casing, thereby disposing the apparatus in sealing engagement with the well head.

In operation, a drilling ship 1 lowers fluid control device 10 via conduit 13 from a position adjacent to well head 5 as shown in FIGS. 1 and 4, to a lower position as shown in FIGS. 2 and 5 (wherein a tapered portion 28 is shown projecting above well head 5). Upon further lowering, the fluid control device 10 is inserted farther into the well head 5, as shown in FIGS. 3 and 6 (wherein only a top portion 25 of fluid control means 10 is shown projecting above well head 5). Finally, the top portion 25 engages with the well head, thereby sealing same, as illustrated in FIG. 7.

Figure 10A:
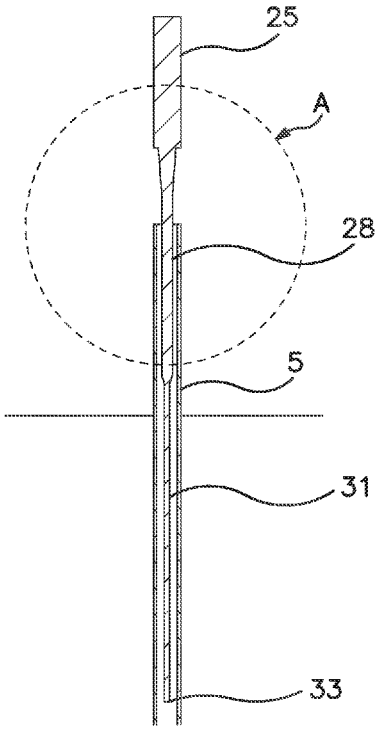
FIG. 10(*a*) is a cross-sectional view of the of the fluid control device of the present invention and well head casing, illustrating the alignment and disposition of the device right as the tapered section thereof is being lowered into the well head casing.
Figure 10B:
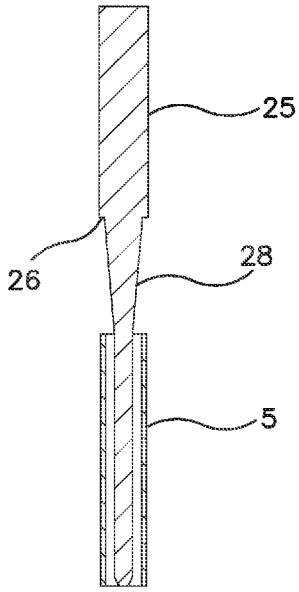
Figure 11A:
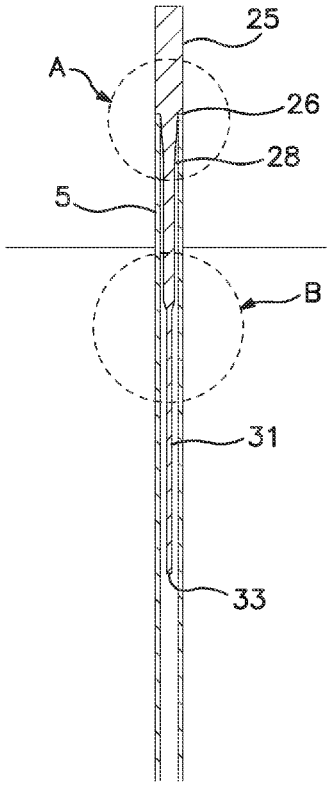
FIG. 11(*a*) is a cross-sectional view of the of the fluid control device of the present invention and well head casing, illustrating the alignment and disposition of the device after the shoulder thereof has come to rest upon the well head casing, thereby sealing same. However, sealing is not necessarily at the top portion of the outflowing pipe. Rather, sealing can be achieved anywhere in the outflowing piping because the segments can be lined with soft materials so that they can be pressed or positioned into cracked pipes and provide the sealing at a solid (uncracked) portion. The soft lining can be hundreds to thousands of feet in length if needed.
Figure 11B:
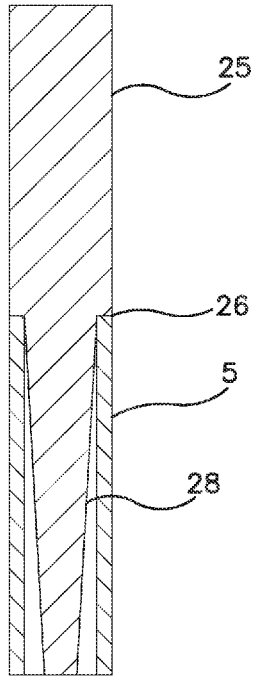
Figure 11C:
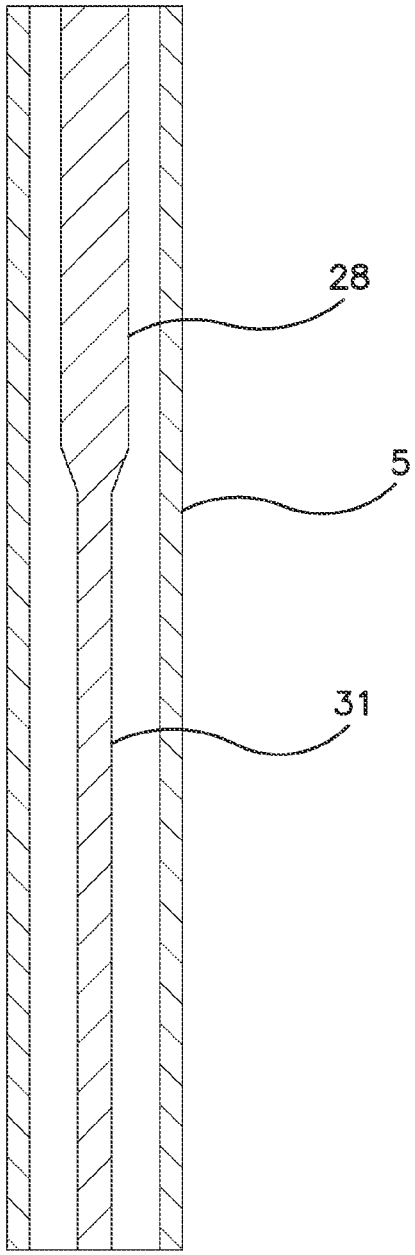

Specifically, FIGS. 4, 8(*a*) and 8(*b*) illustrate preferred sections of the fluid control device 10 including a lowermost section which extends from the tip 33 to a juncture 35 with a tapered section 28. The progressive lowering of fluid control device 10 is illustrated in FIGS. 5-7 and 9(*a*)-11(*c*), during which fluid control device 10 is lowered from above open well head 5 (see FIGS. 4, 8(*a*) and 8(*b*)) into well head 5, and then tapered section 28 enters well head 5 (see FIGS. 6, 10(*a*), 10(*b*)), and finally section 25 of fluid control means 10 comes into contact with and in sealing engagement with well head 5 (see FIGS. 7, and 11(*a*)-(*c*)).

FIGS. 1-3 show the optional use of a support means 17 resting on a platform 6, and the use of alignment means 20 to assist in guiding fluid control means 10 into the well head 5. Although not required to insert the fluid control device into the well head, the alignment means 20 decreases the difficulty of aligning the tip 33 with the well head casing 5.

The fluid control device 10 of the present invention can be gradually inserted into the orifice or open end of a flowing well head 5 so that the flow is gradually reduced with each segment of the tool tip (FIGS. 4-7). In the case of a deep drilled oil pipe, the segment lengths could be hundreds of feet or longer, as the flow and pressures require. Importantly, a gradual reduction in pressure is preferable, so as not to shock the current flowing pipe (well pipe) because this could further rupture the existent pipe assets.

The fluid control device 10 can be made such that it could be transported or delivered to the targeted well head casing using current (conventional) oil pipe segments. However, rather than inserting piping onto/into the well head casing 5, the fluid control device, as shown in FIGS. 1-3, would be attached to the leading oil pipe segment. The current oil pipe sections would serve to deliver, locate, position and apply pressure onto the solid tip 33 of the fluid control device 10, so as to overcome the forces (flows and pressures) of the flowing oil and gas mixture. Conventional drilling rigs can apply 600,000 pounds or more of pressure upon the pipe segments 13, and thus upon the fluid control device 10, an amount of pressure capable of overcoming tremendous flow rates of petroleum, byproducts thereof, and natural gases.

An alternate method of using the solid fluid control means 10 is to configure the device 10 to have a mass greater than the forces being exerted by the flowing oil and gas mixture, and thereby allowing gravity to provide most or all of the force necessary to plug the well. This mass could be derived (consist of) only mass from the solid fluid control means 10 itself, or by adding a shoulder and/or connection means for the addition of extra weights (not shown). The combination of the solid fluid control means 10 with the drill piping 13 can be used to locate and lower the fluid control means 10 into the well head 5 and then weights can be added so that the connection pipes can be sealed and cut-off.

Figure 12:
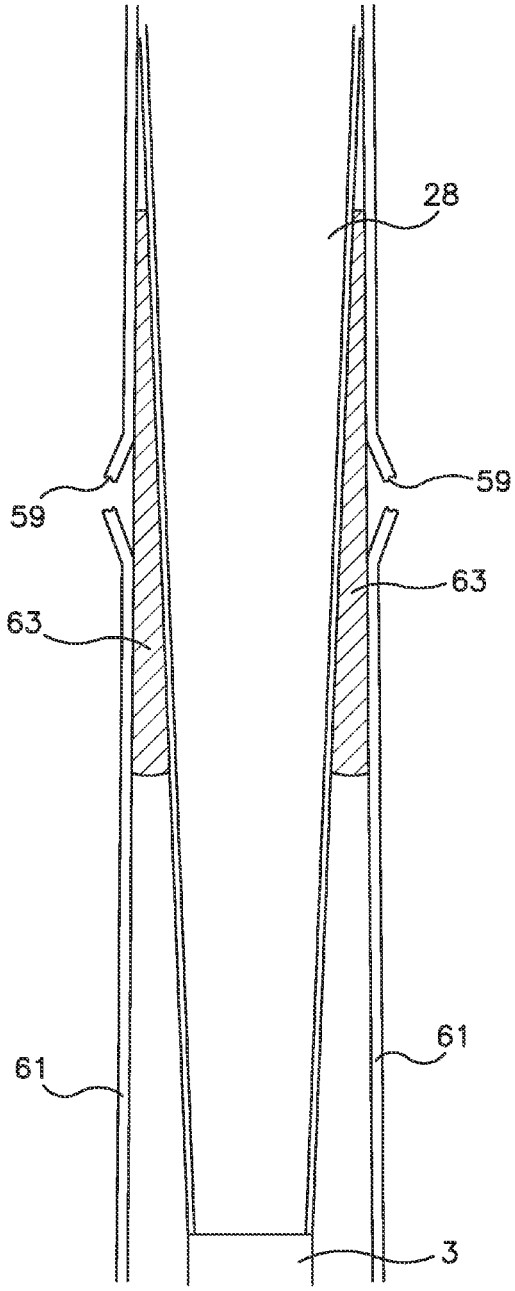
FIG. 12 is a partial cross-sectional view of the fluid control device, illustrated the preferred embodiment wherein the fluid control device is configured to seal the well bore pipe below a subsurface crack therein.

Further, as mentioned above, the fluid control means 10 can have a sealing means (i.e., a soft material, O-ring, etc.) coated or disposed thereon operable to create a seal between the device 10 and the well head 5. Alternatively, as shown in FIG. 12, a seal between the device 10 and the ID of a subsurface portion of the outflowing pipe using soft materials coated/disposed on the fluid control device sections (such as an "O" ring, soft metal, etc.), by simply pressing the soft portion of a section beyond the cracked section of a pipe against the pipe, so as to provide the sealing means. This could be any conventional sealing device including a tapered section that contacts the well head casing. The forces or shear weight add the necessary load to stop or reduce the flow at the joint.

In a preferred embodiment, as mentioned above, a soft material contact can be disposed on at least a portion of the tapered section 28, shoulder 26 and/or top section 25 to provide a greater sealing effect, the soft material consisting of one or more of lead, rubber or plastic to seal the joint. Further, an expansion joint, such as a collet, can be used to expand and create a seal between the pipes.

The fluid control means 10 of the present invention provides a drill team with an ability to slow the flow rate of the oil and gas mixture using a segmented fluid control means 10. It also reduces the expansion of the methane gas to a rate that freezing does not occur as is in the current BP outflow. Further, it gives drillers the ability to go beyond any cracked pipe segment with a smaller diameter segment, and thus reduce the outflow and/or natural gas. Flow reduction (not stoppage) is also a desired feature.

This means that cracked pipes hundreds if not thousands of feet below the sea surface can be bypassed or repaired using the device and method of the present invention. With the use of soft material lining on the taper fluid control device sections, a seal between the ID of the outflowing pipe and the fluid control device can be made. There is no other current method or device that can achieve same. A sealing means can also be used to seal a well head at any location desired.

Although specific embodiments of the present invention have been disclosed herein, those having ordinary skill in the art will understand that changes can be made to the specific embodiments without departing from the spirit and scope of the invention. Thus, the scope of the invention is not to be restricted to the specific embodiments. Furthermore, it is intended that the appended claims cover any and all such applications, modifications, and embodiments within the scope of the present invention

What is claimed is:

1. An apparatus for controlling and/or stopping the flow of petroleum and/or natural gas from an open well head on the sea floor in which the well head is in communication with a subterranean formation, said apparatus comprising:

a flow control device comprising:

(a) an elongated member which can be lowered at least partially into the open well head, said elongated member comprised of a plurality of sections of different diameters, including a lowermost end section having a diameter less than the inside diameter of a well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, wherein downward force exerted by the mass and/or external force exerted on the fluid control device is sufficiently great so as to overcome any upward force created by flowing fluids, such as petroleum and/or natural gas, and wherein the downward force results in the downward movement of the fluid control device into the well head casing resulting in closure of the well head, and wherein two or more of the plurality of sections and the elongated member are in threaded engagement with an adjacent section.

2. The apparatus of claim 1, wherein the fluid control device further comprises a sealing material coated, disposed on or affixed to at least a portion of one or more tapered sections.

3. The apparatus of claim 2, wherein the sealing material is made of a soft material.

4. The apparatus of claim 2, wherein the sealing material is made of a material selected from a group consisting essentially of: lead, rubber, and plastic.

5. The apparatus of claim 2, for use to seal a defect that develops in the subterranean formation, wherein said at least a portion of one or more tapered sections with the sealing material, has an outer diameter that is approximately equal to an inside diameter of the subterranean formation at the location of the defect, to seal a section of the subterranean formation above and below the defect.

6. The apparatus of claim 5, wherein the defect includes a crack in a well bore pipe.

7. The apparatus of claim 2, wherein the end section includes a shoulder, and wherein the shoulder comes in contact with and rests on top of the well head.

8. The apparatus of claim 7, wherein the sealing material is disposed in proximity to the shoulder, to assist in providing a tight seal between the shoulder and the well head.

9. The apparatus of claim 1, wherein the fluid control device further comprises a sealing material coated, disposed on or affixed to at least a portion of the end section.

10. The apparatus of claim 1, further comprising a guide means operable to align the fluid control device with the open well head.

11. An apparatus for controlling and/or stopping the flow of petroleum and/or natural gas from an open well head on the sea floor in which the well head is in communication with a subterranean formation, said apparatus comprising:

a flow control device comprising:

(a) an elongated member which can be lowered at least partially into the open well head, said elongated member comprised of a plurality of sections of different diameters, including a lowermost end section having a diameter less than the inside diameter of a well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, wherein downward force exerted by the mass and/or external force exerted on the fluid control device is sufficiently great so as to overcome any upward force created by flowing fluids, such as petroleum and/or natural gas, and wherein the downward force results in the downward movement of the fluid control device into the well head casing resulting in closure of the well head, and wherein the elongated member has a maximum diameter one half or less than an inside diameter of the well head casing.

12. An apparatus for controlling and/or stopping the flow of petroleum and/or natural gas from an open well head on the sea floor in which the well head is in communication with a subterranean formation, said apparatus comprising:

a flow control device comprising:

(a) an elongated member which can be lowered at least partially into the open well head, said elongated member comprised of a plurality of sections of different diameters, including a lowermost end section having a diameter less than the inside diameter of a well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, wherein downward force exerted by the mass and/or external force exerted on the fluid control device is sufficiently great so as to overcome any upward force created by flowing fluids, such as petroleum and/or natural gas, and wherein the downward force results in the downward movement of the fluid control device into the well head casing resulting in closure of the well head, and further comprising a drilling pipe in connection with the end section, the drilling pipe operable to enable lowering of the fluid control device to the sea floor and into the open well head.

13. A method for controlling and/or stopping the flow of petroleum and/or natural gas from an open well head on the sea floor in which the well head is in communication with a subterranean formation, said apparatus comprising:

lowering a flow control device at least partially into the open well head, the flow control device comprising:

(a) an elongated member including a plurality of sections of different diameters, and having a lowermost end section with a diameter less than the inside diameter of a well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, exerting a downward force on the fluid control device that is sufficiently great so as to overcome an upward force created by flowing fluids, such as petroleum and/or natural gas, and wherein the downward force results in the downward movement of the fluid control device into the well head casing resulting in closure of the well head, and threadably engaging two or more of the plurality of sections and the elongated member with an adjacent section.

14. A method for controlling and/or stopping the flow of petroleum and/or natural gas from an open well head on the sea floor in which the well head is in communication with a subterranean formation, said apparatus comprising:

lowering a flow control device at least partially into the open well head, the flow control device comprising:

(a) an elongated member including a plurality of sections of different diameters, and having a lowermost end section with a diameter less than the inside diameter of a well head casing, wherein the elongated member has a maximum diameter one half or less than an inside diameter of the well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, exerting a downward force on the fluid control device that is sufficiently great so as to overcome an upward force created by flowing fluids, such as petroleum and/or natural gas, and wherein the downward force results in the downward movement of the fluid control device into the well head casing resulting in closure of the well head.

15. A method for controlling and/or stopping the flow of petroleum and/or natural gas from an open well head on the sea floor in which the well head is in communication with a subterranean formation, said apparatus comprising:

lowering a flow control device at least partially into the open well head, the flow control device comprising:

(a) an elongated member including a plurality of sections of different diameters, and having a lowermost end section with a diameter less than the inside diameter of a well head casing, and (b) one or more tapered sections in connection or formed integral with the elongated member, the tapered sections having a variable diameter, at least one of the tapered sections increasing in diameter to a diameter at least equal to the inside diameter of the well head casing, and (c) an end section in connection or formed integral with the tapered section, the end section having a diameter greater than or equal to the outside diameter of the well casing, exerting a downward force on the fluid control device that is sufficiently great so as to overcome an upward force created by flowing fluids, such as petroleum and/or natural gas, and wherein the downward force results in the downward movement of the fluid control device into the well head casing resulting in closure of the well head, and connecting a drilling pipe to the end section, wherein the drilling pipe is operable to enable lowering of the fluid control device to the sea floor and into the open well head.

* * * * *